US007391976B2

(12) United States Patent
Kobayashi et al.

(10) Patent No.: US 7,391,976 B2
(45) Date of Patent: Jun. 24, 2008

(54) OPTICAL ACOUSTOELECTRIC TRANSDUCER

(75) Inventors: Okihiro Kobayashi, Yokohama (JP); Nobuhiro Miyahara, Ota-ku (JP); Yutaka Hattori, Machida (JP); Hiroshi Miyazawa, Tokorozawa (JP); Junichi Hayakawa, Kawasaki (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 1022 days.

(21) Appl. No.: 10/149,011

(22) PCT Filed: Dec. 11, 2000

(86) PCT No.: PCT/JP00/08743

§ 371 (c)(1),
(2), (4) Date: Jun. 7, 2002

(87) PCT Pub. No.: WO01/43494

PCT Pub. Date: Jun. 14, 2001

(65) Prior Publication Data

US 2003/0002129 A1 Jan. 2, 2003

(30) Foreign Application Priority Data

| | | |
|---|---|---|
| Dec. 13, 1999 | (JP) | 11-353619 |
| Dec. 13, 1999 | (JP) | 11-353620 |
| Feb. 14, 2000 | (JP) | 2000-035948 |
| Apr. 10, 2000 | (JP) | 2000-108471 |

(51) Int. Cl.

| | |
|---|---|
| ***H04B 10/02*** | (2006.01) |
| ***G02F 1/11*** | (2006.01) |
| ***H04R 25/00*** | (2006.01) |

(52) U.S. Cl. ..... 398/133; 398/132; 359/285; 381/172

(58) Field of Classification Search ..... 398/285, 398/286, 287, 132–134; 181/148; 381/357, 381/358, 172; 73/653, 655; 356/447, 225; 362/86–88; 359/285–287
See application file for complete search history.

(56) References Cited

U.S. PATENT DOCUMENTS

| | | | | |
|---|---|---|---|---|
| 4,463,222 | A * | 7/1984 | Poradowski | 381/357 |
| 6,069,905 | A * | 5/2000 | Davis et al. | 372/50.124 |
| 6,651,504 | B1 * | 11/2003 | Datskos | 73/651 |

FOREIGN PATENT DOCUMENTS

| | | | |
|---|---|---|---|
| DE | 1 512 663 | | 6/1969 |
| EP | 0 777 404 | | 6/1997 |
| GB | 313986 | * | 6/1929 |
| GB | 986138 | | 3/1965 |
| JP | 57-23342 | A | 2/1982 |
| JP | 58-69499 | A | 6/1983 |
| JP | 61-18916 | A | 1/1986 |
| JP | 63-260396 | * | 10/1988 |
| JP | 63-260396 | * | 10/1998 |

OTHER PUBLICATIONS

International Search Report dated Feb. 27, 2001.
Supplementary International Search Report dated Oct. 25, 2006 for Application No. 00981656.2.
Zollner, M. et al., *Betriebsverhalten von realen Wandlern*, Elektroakustik, 1993, Springer, Berlin, pp. 181-199.
Huber, David Miles, Microphone Characteristics, 1988, Sams, Indianapolis, pp. 25-33.

* cited by examiner

*Primary Examiner*—Jason Chan
*Assistant Examiner*—Nathan Curs
(74) *Attorney, Agent, or Firm*—Eric J. Robinson; Robinson Intellectual Property Law Office, P.C.

(57) ABSTRACT

An optical acoustoelectric transducer having a directivity pattern like a better 8 by receiving by a light-receiving element a reflected fraction of the light from a light-emitting device disposed at the center of a bottom plate that is parallel to a diaphragm, has an opening through which an acoustic wave enters, and is connected to supporting side plates. An optical acoustoelectric transducer having uniform amplitude characteristics in a wide frequency range by mixing by a mixer circuit the outputs of a plurality of optical microphones having diaphragms of mutually different thicknesses so as to make the receiving sensitivity uniform in different frequency ranges. A directional optical acoustoelectric transducer having a small size and wide band characteristics by arranging a plurality of light-emitting devices (LD) and a plurality of light-receiving elements (PD) corresponding to a plurality of diaphragms arranged parallel.

17 Claims, 12 Drawing Sheets

(a)

(b)

OPTICAL ACOUSTOELECTRIC TRANSDUCER

TECHNICAL FIELD

The present invention relates to an optical acoustoelectric transducer for converting vibration displacement of a vibrating board into an electric signal by using light.

BACKGROUND ART

There is a microphone as an acoustoelectric transducer. In general, in order to provide sharp directivity for sensitivity in an incident direction of a sound wave vertical to a vibrating board of the microphone, it is necessary to configure a microphone apparatus so as to have the sound wave incident not only on a front portion but also on a back portion of the vibrating board.

As for a dynamic microphone broadly used in the past, it has a configuration wherein a coil is mounted on the vibrating board in order to detect the sound wave from the vibrating board, and so the coil and so on resist sound pressure entering from the back so that the vibrating board cannot always be vibrated as on the front. It was difficult, however, to provide the configuration wherein the front portion and the back portion of the vibrating board are completely opened so as to render the sound wave incident from both the front portion and the back portion.

In addition, as for a condenser microphone, it has the configuration wherein, as it detects the sound wave by detecting change of capacity due to vibration of the vibrating board, the back cannot be structurally opened to render the sound wave incident from the backside. Accordingly, it is ideal that the acoustoelectric transducer such as the microphone has nothing on its back as on its front.

Moreover, an optical microphone apparatus using an optical device is known as one of the microphones.

For instance, Japanese Patent Application Laid-Open No. 8-297011 discloses an optical fiber sensor using a pair of optical fibers and having a configuration wherein light is irradiated to a vibration medium from one optical fiber connected to a light source and the light is detected by the other optical fiber, indicating that it is applicable to a microphone.

An optical microphone device used for the optical microphone apparatus is comprised of the vibrating board for vibrating due to sound pressure, the light-emitting device for irradiating a light beam on this vibrating board, and the light-receiving element for receiving reflected light from the vibrating board and outputting a signal corresponding to vibration displacement of the vibrating board.

Thereby it is possible to detect the vibration displacement of the vibrating board caused by the fact that the sound wave hits the vibrating board without touching this vibrating board and to convert the detected vibration displacement to an electric signal, so that it is no longer necessary to place a vibration detecting system on the vibrating board, weight of the vibrating portion can be rendered lighter, and feeble variation of the sound wave can be sufficiently followed.

A first objective of the present invention is, for the purpose of solving the above-mentioned first problem, to provide the acoustoelectric transducer having the directivity, as its directional characteristic, only in the vertical direction to the vibrating board.

In addition, as for the microphone in the past, the apparatus is configured by using a single optical microphone device so that one vibrating board covers frequency characteristics ranging from low to high frequencies.

Such a microphone characteristic is generally called a monotone characteristic, where frequency coverage is actually almost limited to 50 Hz to 20 KHz as shown in FIG. 11.

Thus, as the optical microphone apparatus in the past used a single optical microphone device using a single vibrating board, it is difficult to control the low to high frequencies with the single vibrating board so as to render the sensitivity (amplitude) thereof flat. In general, the sensitivity in a low frequency band is relatively enhanced by increasing thickness of the vibrating board, and the sensitivity in a high frequency band is enhanced by decreasing the thickness thereof.

Accordingly, it is difficult, due to such a physical property of the vibrating board, to implement the optical microphone apparatus of which frequency characteristic of the sensitivity (amplitude) is flat over a wide frequency band.

A second objective of the present invention is, for the purpose of solving such a second problem in the past, to provide the acoustoelectric transducer like the optical microphone apparatus of which sensitivity (amplitude) characteristic is flat over a wide frequency band.

Furthermore, in case of configuring the optical microphone apparatus of the wide frequency band by arranging a plurality of the past optical microphone devices, there is a fault that the vibrating board cannot be rendered close or the shape thereof becomes larger. For that reason, it is difficult to implement a small and wide-band directional microphone apparatus.

Moreover, as the size of the vibrating board of the microphone apparatus is fixed, it is difficult to have settings with featured frequency characteristics and to implement the microphone apparatus which is efficient in the wide frequency band.

A third objective of the present invention is, for the purpose of solving the above-mentioned third problem, to provide the directional acoustoelectric transducer which is small and has the wide-band frequency characteristic.

DISCLOSURE OF THE INVENTION

In order to attain the above first objective of the present invention, an acoustoelectric transducer of the present invention has a configuration wherein a vibrating board for vibrating due to sound pressure, a light-emitting device for irradiating a light beam on the above described vibrating board, a light-receiving element for receiving reflected light of the above described light beam irradiated on the above described vibrating board and outputting a signal corresponding to vibration displacement of the above described vibrating board, a bottom plate having the above described light-emitting device and the above described light-receiving element placed thereon and provided opposite the above described vibrating board, and a supporting side plate for coupling the above described vibrating board and the above described bottom plate to be almost parallel and close are provided, and the above described light-emitting device and light-receiving element are placed almost in the center of the above described bottom plate, with a first opening of the size allowing the sound wave to enter in a periphery.

A plurality of the above described first openings may be provided. In addition, it is possible, on the above described acoustoelectric transducer, to provide a second opening of the size allowing the sound wave to enter on the above described supporting side plate. Furthermore, it is also possible to provide a plurality of the above described second openings.

In order to attain the above second objective, the acoustoelectric transducer of the present invention has the configuration wherein an acoustoelectric transducing device is provided with the vibrating board for vibrating due to sound pressure, the light-emitting device for irradiating the light beam on the above described vibrating board, and the light-receiving element for receiving the reflected light of the above described light beam irradiated on the above described vibrating board and outputting the signal corresponding to the vibration displacement of the above described vibrating board, a supporting frame for placing and fixing a plurality of the above described acoustoelectric transducing devices to position the above described vibrating boards almost on the same plane, a light source driving circuit for driving the above described light-emitting devices by supplying a predetermined current to each of the light-emitting devices of the above described plurality of acoustoelectric transducing devices, and a mixer circuit for mixing output signals from each light-receiving element of the above described plurality of acoustoelectric transducing devices, and the thickness of each vibrating board of the above described plurality of acoustoelectric transducing devices is rendered different so as to make receiving sensitivity almost even in mutually different frequency ranges.

In the above described acoustoelectric transducer, the above described acoustoelectric transducing device may be the configured to have a light-emitting and light-receiving device wherein the above described light-emitting device and light-receiving elements are placed on the same substrate, and the above described light-emitting device is a vertical cavity surface-emitting light-emitting device of which intensity distribution of light emission is concentrically almost even and is placed in the center of the above described substrate, with the above described light-receiving elements concentrically placed to surround the above described light-emitting devices.

In addition, it is possible to provide the above described vibrating board almost in parallel with and close to the above described substrate.

The above described acoustoelectric transducing devices can be provided so as to have the above described vibrating board exposed in the opening formed on a frame surface of the above described supporting frame.

Furthermore, it is possible to render the frequency characteristic of the sensitivity of the output signals from the above described mixer circuit almost flat in the range of 1 Hz to 100 KHz.

In order to attain the above third objective, an optical acoustoelectric transducer of the present invention has in its cabinet the vibrating board for vibrating due to sound pressure, the light-emitting device for rendering the light incident on the above described vibrating board, and the light-receiving element for receiving the reflected light from the above described vibrating board and outputting acoustic displacement of the above described vibrating board by converting it into change of the electric signal, wherein a plurality of the vibrating boards are provided and a plurality of the above described light-receiving elements are provided to correspond to each vibrating board. And in the first embodiment, a plurality of the light-emitting devices are provided to correspond to each of the plurality of the vibrating boards and the light-receiving elements. Also, the second embodiment has the configuration wherein a single light-emitting device is provided, and a plurality of the light-receiving elements receive the light beam from this single light-emitting device via a reflection path corresponding to each of the plurality of vibrating boards. In addition, the plurality of vibrating boards are placed in parallel on different planes by keeping predetermined spacing, or placed on the same plane apart from one another. Furthermore, these vibrating boards are comprised of combinations of different sizes of the same thickness, for instance, in order to have different fundamental frequencies respectively. Moreover the first embodiment of the present invention has each of the plurality of light-emitting devices placed on the same plane as the light-receiving element corresponding thereto, and the second embodiment has the single light-emitting device and the plurality of light-receiving elements placed on the same plane. Preferably, a vertical cavity surface emitting laser (VCSEL) should be used as the light-emitting device, and the following configurations or the like should be adopted.

(i) The light-receiving elements are provided to surround the VCSEL concentrically having almost even intensity distribution of light emission. (ii) A number of openings are provided to the cabinet so that sound reaches the above described vibrating board via these openings. (iii) A half mirror effect is given to some of the plurality of vibrating boards. Or (iv) The light beam is distributed via a half mirror device placed in the cabinet so as to have it irradiated on each vibrating board.

EMBODIMENTS

Figure 1:
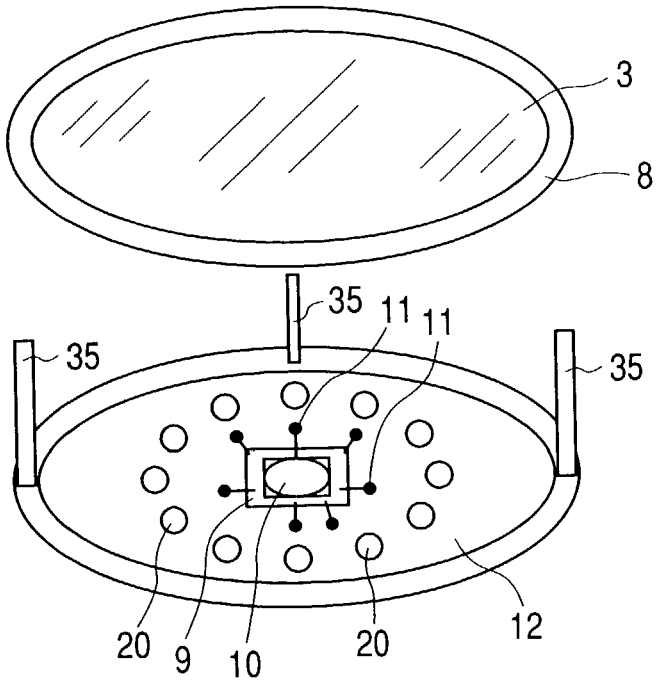
FIG. 1 is a exploded perspective view showing a configuration of an optical microphone apparatus according to an embodiment of the present invention I.

Hereafter, a configuration and an operation of an optical acoustoelectric transducer of the present invention will be described by referring to the drawings taking an optical microphone apparatus as an example. The present invention is largely classified into three types in relation to its object and configuration. Thus, in the following description, the inventions for attaining the above-mentioned first, second and third objects are referred to as invention I, invention II and invention III for the sake of convenience respectively. Hereafter, the configurations of these invention I, invention II and invention III will be described in order.

Invention I

Figure 5:
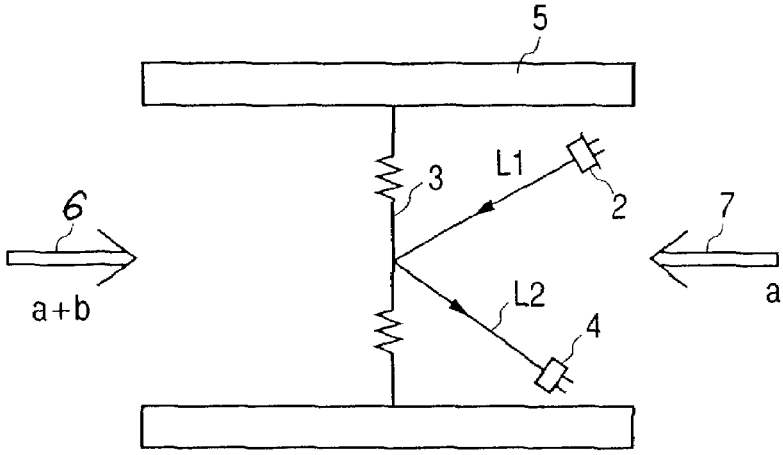
FIG. 5 is a basic principle diagram of the optical microphone apparatus of the present invention II.

FIG. 5 is a drawing showing a basic principle diagram of the optical microphone apparatus having no directivity in a side direction (hereafter referred to as a complete directional characteristic).

A vibrating board 3 for vibrating due to sound pressure of a sound wave is mounted almost in the center of a cabinet 5. And a light-emitting device 2 and a light-receiving element 4 are provided on the backside of the vibrating board 3 so that an incident light beam L1 from the light-emitting device 2 is reflected by the vibrating board 3 to be reflected light L2 and received by the light-receiving element 4. Thus, vibration displacement of the vibrating board 3 is detected, by the light-receiving element 4, as change of a light-receptive position of the reflected light L2.

In this case, a sound wave 6 gets incident from the front of the vibrating board 3 and a sound wave 7 gets incident from the back thereof, where if the respective sound pressure phases are the same, no vibration occurs on the vibrating board 3 and no output is generated from the light-receiving element 4.

On the other hand, in the case where the sound wave 6 of a+b comes from the front direction of the vibrating board 3 and the sound wave 7 of a comes from the backside thereof, the sound wave a is canceled and only b is detected on the vibrating board 3.

Here, in general ambient noise, noise and so on input from the front side and the backside of the microphone with the same phase and amplitude. Accordingly, this becomes the sound wave a.

On the other hand, a speech signal only gets incident as b from the front side of the microphone, and consequently only noise a is canceled by the vibrating board 3 and only speech b is taken out.

Figure 6:
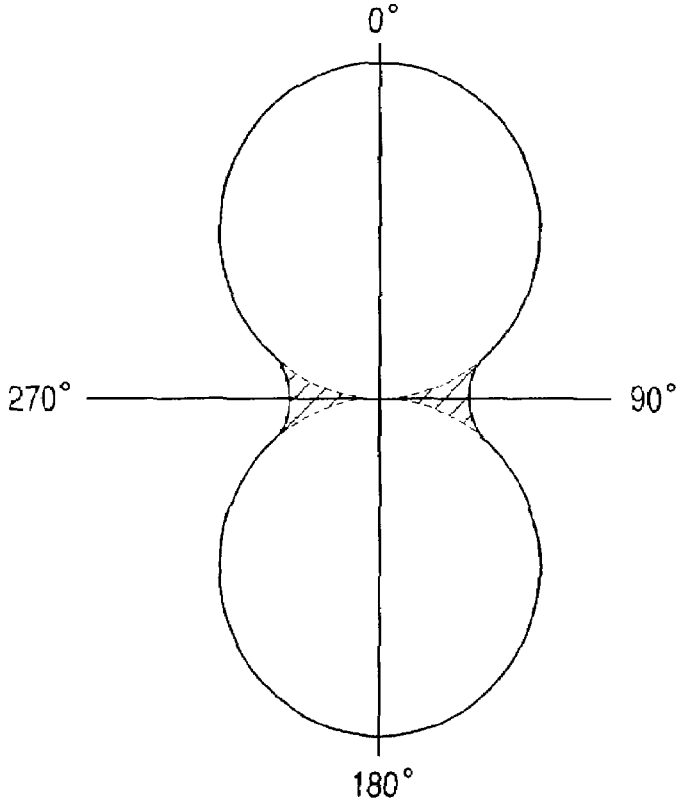
FIG. 6 is a diagram showing a directional characteristic of the microphone apparatus.

Thus, it is possible, by implementing the configuration allowing the sound wave to come to the vibrating board from the front and the backside, to take out only the speech signal so as to reduce the noise. In addition, it is possible, by implementing such a configuration, to obtain the complete directional characteristic as shown by dotted lines in FIG. 6.

Figure 2:
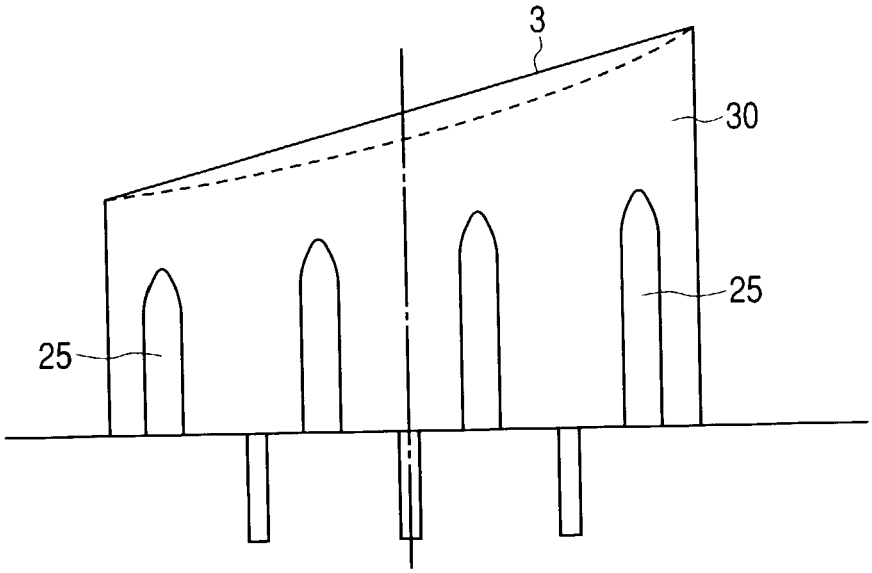
FIG. 2 is a side view of the optical microphone apparatus of the present invention I.
Figure 3:
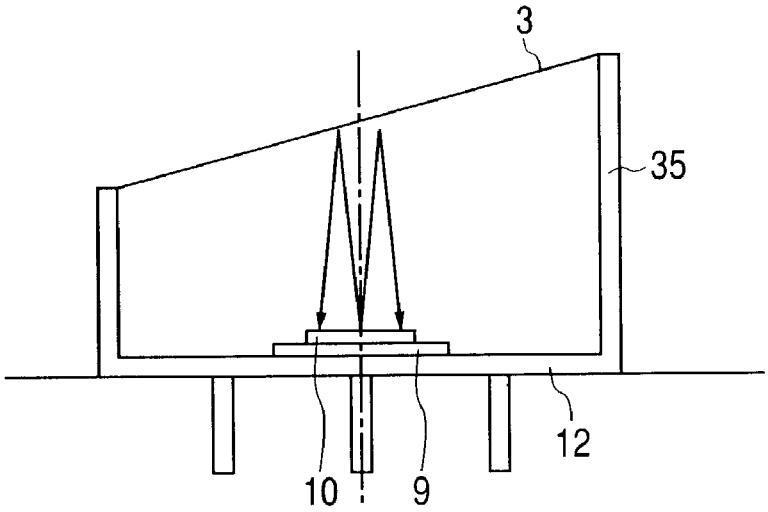
FIG. 3 is a side sectional view of the optical microphone apparatus of the present invention I.

FIGS. 1 to 3 are diagrams showing the configuration of the optical microphone apparatus which is an embodiment of the present invention I, where FIG. 1 shows a exploded perspective view, FIG. 2 shows a side view, and FIG. 3 shows a side sectional view thereof respectively.

As shown in FIGS. 1 and 3, the present invention I has the light-emitting device and the light-receiving element formed as one piece as the light emitting and light-receiving device 10 and mounted on a substrate 9. This substrate 9 is mounted close to the center of a bottom plate 12. The bottom plate 12 is placed almost in parallel with and close to the vibrating board 3.

A supporting side plate 30 for coupling this bottom plate 12 and the vibrating board 3 is formed as shown in FIG. 2. In addition, it is not always necessary to form this supporting side plate 30 to totally surround the bottom plate 12 and the vibrating board 3, but it is also feasible, for example, as shown in FIG. 1, to configure it by erecting supports 35 on the periphery of the bottom plate 12 and connect a periphery 8 of the vibrating board 3 to lower ends of these supports 35.

It has the configuration wherein the substrate 9 on which the light-emitting and light-receiving device 10 is mounted is connected to a terminal 11, and supply of power and delivery of necessary signals are performed to the light-emitting and light-receiving device 10 and peripheral circuits thereof via this terminal 11. In addition, the present invention I has openings 20 provided to the bottom plate 12 so as to render the sound wave from the backside of the vibrating board 3 incident.

It is also feasible, as shown in FIG. 1, to form these openings 20 by providing a plurality of circular holes on a circumference to surround the light-emitting and light-receiving device 10. It is possible, by forming such openings 20 on the bottom plate 12, to induce the noise from the backside to the vibrating board 3.

Moreover, it is possible, in addition to the openings 20 provided on the bottom plate 12, to also provide openings 25 to the supporting side plate 30 so as to allow the sound wave to enter as shown in FIG. 2. However, if the openings 25 provided on the supporting side plate 30 are formed to have excessively large opening area, the speech from the front of the vibrating board 3 diffracts and gets incident on the backside thereof via these openings 25 to cancel the speech, and so it is desirable to provide the openings of an adequate size.

Figure 4:
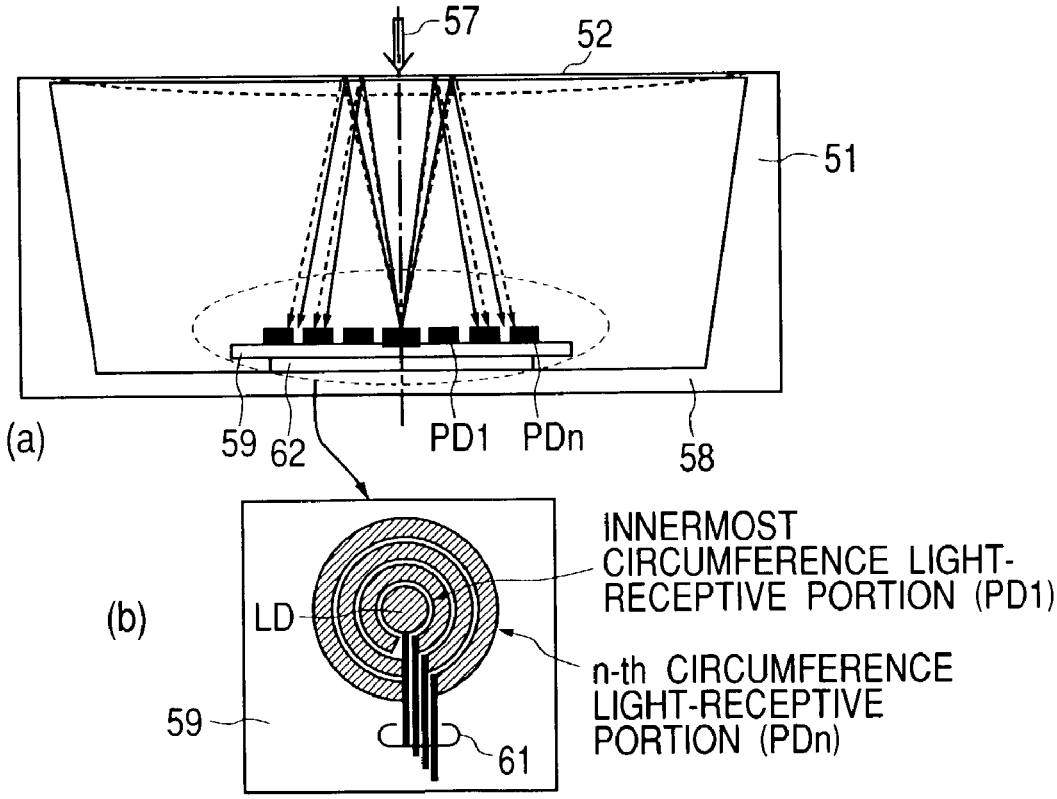
FIG. 4 are a side sectional view and a plan view showing the configuration of the optical microphone apparatus of another embodiment of the present invention I.

FIG. 4 are diagrams showing another embodiment of the present invention I, that is, the diagrams showing the configuration of a head portion of the optical microphone device.

FIG. 4(*a*) shows a sectional shape, where an electronic circuit board 62 is provided on a bottom 58 of a container 51, and a substrate 59 on which the light-emitting device and the light-receiving element are placed is mounted on this board 62. It can also be mounted by electrically connecting the substrate 59 and the board 62 by flip chip bonding for instance. In addition, it is possible, if the bottom 58 is configured with a semiconductor substrate such as silicon, to omit the electronic circuit board 62 since an electronic circuit can be configured thereon. Moreover, the embodiment shown in FIG. 4 uses a vertical cavity surface emitting laser diode LD as the light-emitting device and a photodiode PD as the light-receiving element. The vertical cavity surface emitting laser diode LD in a circular shape is placed in the middle of the substrate 59, and the light-receiving elements PD are concentrically provided to surround the LD.

FIG. 4(*b*) is a plane showing enlarged light receptive and emitting portions of the substrate 59 on which the light-emitting device and light-receiving elements shown as enclosed by a dotted line in FIG. 4(*a*) are mounted.

As shown in the drawing, the light-emitting device LD in the circular shape is placed in the center, and the light-receiving elements PD1, PD2 . . . PD*n* are concentrically provided to surround it. Moreover, the vertical cavity surface emitting laser can be used as the light-emitting device LD used here.

These light-emitting devices LD and the light-receiving elements PD can be simultaneously manufactured on a gallium arsenide wafer by a semiconductor manufacturing process.

Accordingly, alignment accuracy of the light-emitting devices LD and the light-receiving elements PD is determined by accuracy of a mask used in the semiconductor manufacturing process, and so it is possible, as the alignment accuracy thereof can be rendered as 1 μm or less, to implement it with high accuracy of a one millionth or less compared to the alignment accuracy of the light-emitting device and the light-receiving elements of optical microphone devices of the past.

In general, a vertical cavity surface emitting device has a characteristic that its intensity distribution of the light emission is concentrically almost even. Accordingly, radiated light that is radiated toward a vibrating board 52 at a predetermined angle from the light-emitting device LD placed in the center is concentrically reflected with the same intensity, and its reflection angle is changed by vibration of the vibrating board 52 due to reception of a sound wave 57 so that it concentrically reaches the light-receiving elements PD.

Accordingly, the vibration displacement of the vibrating board 52 can be detected by detecting the change of a received light amount of the concentrically placed light-receiving elements PD1 . . . PDn. It becomes usable as the optical microphone device since it can thereby detect the intensity of the incident sound wave 57.

Moreover, an electrode 61 is formed in order to drive the light-emitting devices LD and the light-receiving elements PD or to detect an incident light amount.

Moreover, it is the same as the embodiment shown in FIGS. 1 to 3 that the openings not shown are provided on a side wall and the bottom 58 of the container 51.

As this embodiment uses the light-emitting device and the light-receiving element using the vertical cavity surface emitting device (VCSEL) and the photodiode (PD) configured in a monolithic structure on the same plane, it is very small, able to secure large space on the backside of the vibrating board and eliminate a resistance to the sound pressure.

Moreover, the present invention I is not limited to the optical microphone apparatus but is also applicable to an optical sensor.

Invention II

Figure 7:
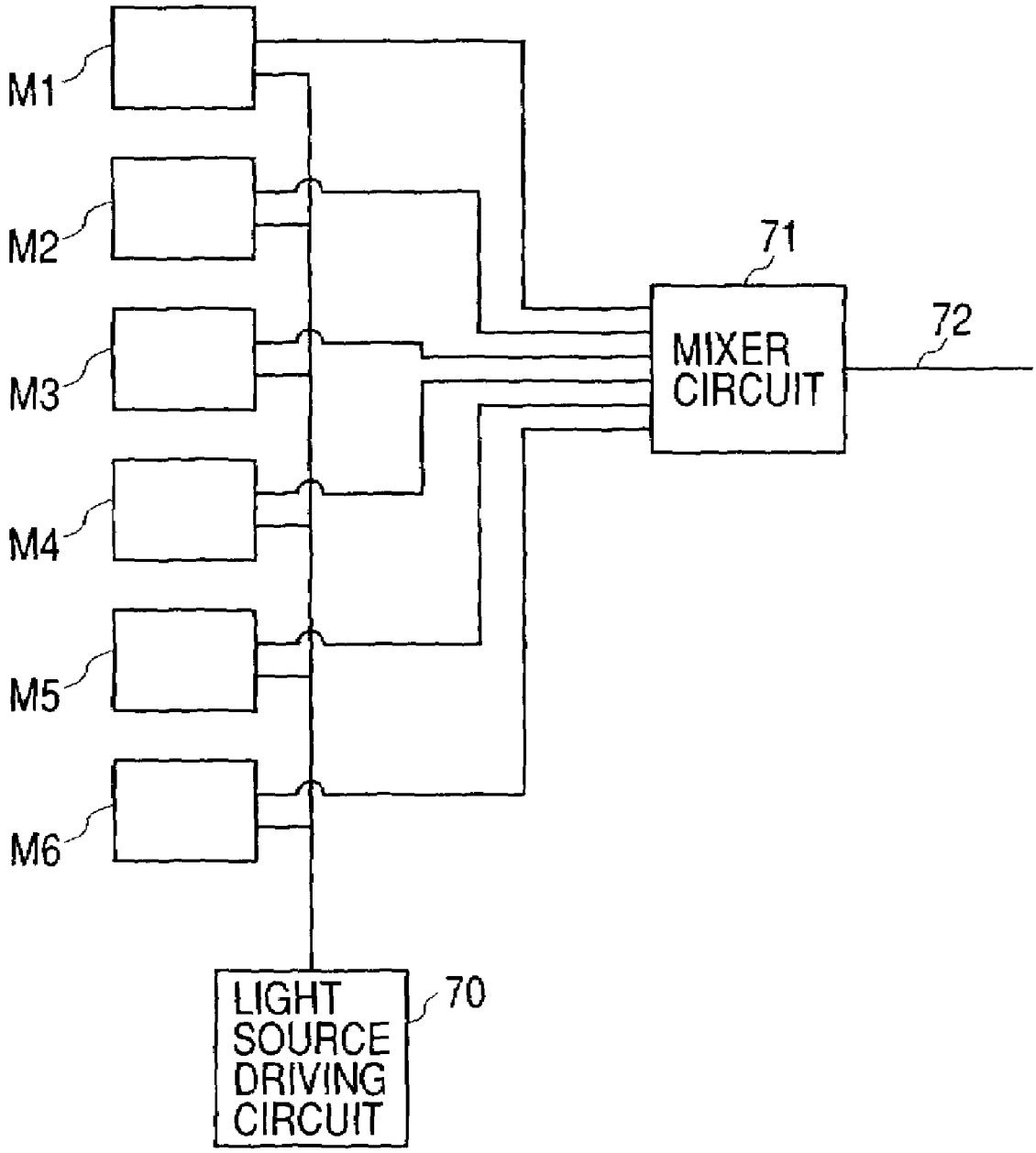
FIG. 7 is a block circuit diagram showing the configuration of the optical microphone apparatus which is an embodiment of the present invention II.

FIG. 7 is a block diagram showing the configuration of the optical microphone apparatus which is an embodiment of the present invention II.

In the present invention II, the optical microphone device compounded by combining a plurality of light-receiving elements M1, M2, . . . M6 of which thickness of the vibrating board is mutually different respectively is formed, and it has the configuration wherein the output from each light-receiving element thereof is inputted to a mixer circuit 71 and mixed and is taken out as an output signal 72. It is configured so that a predetermined driving current is supplied to the light-emitting device of each of the optical microphone devices M1 to M6 from a light source driving circuit 70.

Figure 8:
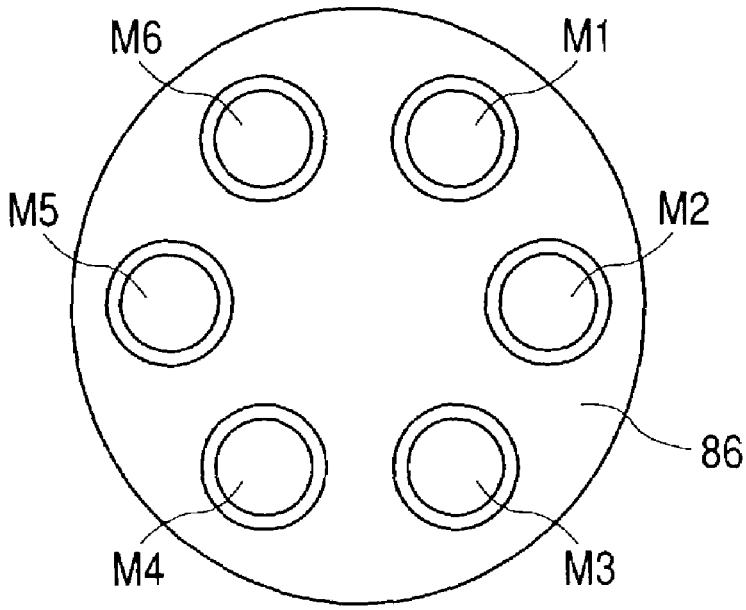
FIG. 8 are a plan view and a side sectional view showing the configuration of the optical microphone device used in the present invention II.
Figure 8:
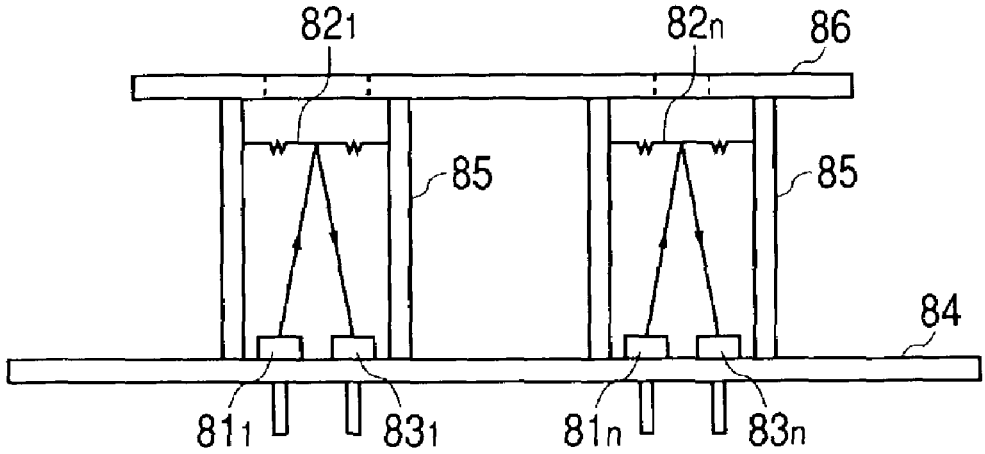

FIG. 8 are diagrams showing the configuration of the compound optical microphone device configured by combining the plurality of optical microphone devices M1 to M6, where (a) shows a top view and (b) shows a side sectional view thereof respectively.

The optical microphone devices M1 to M6 are configured by having each of them sectioned by a shielding plate 85 as shown in FIG. 8(*b*), and are placed and fixed so as to position vibrating boards 82 of the plurality of optical microphone devices M1 to M6 almost on the same plane as supporting frames 84 and 86. Each optical microphone device is comprised of a light-emitting device 81 and a light-receiving element 83 mounted on the substrate not shown and the vibrating boards 82 placed almost in parallel with and close to the substrate having the light-emitting device 81 and the light-receiving element 83 mounted thereon, having the configuration wherein the light beam from the light-emitting device 81 is reflected by the vibrating boards 82 and received by the light-receiving element 83 so that the signal corresponding to the vibration displacement of the vibrating boards 82 is taken out.

As shown in FIG. 8(*a*), each vibrating board 82 is placed to be exposed in the opening formed on a frame surface 86 of the supporting frames 84 and 86.

These vibrating boards 82 are placed to be located in the same plane as the frame surface 86 and are fixed on the supporting frames 84 and 86.

FIG. 4(*b*) is a diagram showing the configuration of the light-emitting and light-receiving device of the optical microphone devices M1 to M6 used in the present invention II.

The vertical cavity surface emitting laser diode LD and the light-receiving elements PD such as the photodiodes are placed on the gallium arsenide substrate 59. The laser diode LD is formed in the center of the substrate 59, and a plurality of the light-receiving elements PD are concentrically formed to surround it. Electrodes 8 are taken out of the laser diode LD and the light-receiving elements PD.

The vertical cavity surface emitting laser diode LD has the a characteristic that its intensity distribution of the light emission is concentrically almost even, where the laser beam concentrically radiated from this laser diode LD is concentrically reflected by the vibrating board, and it is received by the light-receiving elements PD to be taken out as a receiving signal.

Moreover, as for the light-emitting and light-receiving device shown in FIG. 4(*b*), the light-receiving elements can be taken out by differential output since they are concentrically formed on a plurality of circles, and it is thereby possible to absorb an error such as temperature change of the laser diode LD.

Here, the vibrating board of the optical microphone device used in the present invention II will be described.

Figure 9:
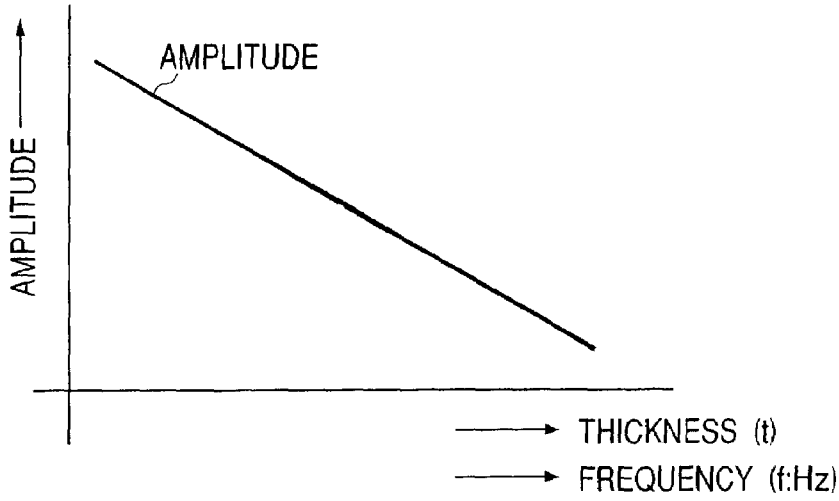
FIG. 9 is a diagram showing a relationship between thickness and amplitude of a vibrating board of the optical microphone device used for the present invention II as to frequencies.

FIG. 9 is a diagram showing a relationship between a thickness t and an amplitude characteristic of the vibrating board.

To be more specific, in the case where a frequency f of a wave-receptive sound wave is low, the thinner the thickness t of the vibrating board is, the larger the amplitude becomes. And if the frequency is high, the thicker the thickness t is, the smaller the amplitude becomes.

The present invention II utilizes this property so that the thickness of the respective vibrating boards of the plurality of optical microphone devices M1 to M6 becomes different to have almost even receiving sensitivity in mutually different frequency ranges.

To be more specific, a reproducible frequency range of the sound waves is limited for the vibrating board of each optical microphone device, so that the vibrating board of the thickness conforming to that frequency range is set.

Figure 10:
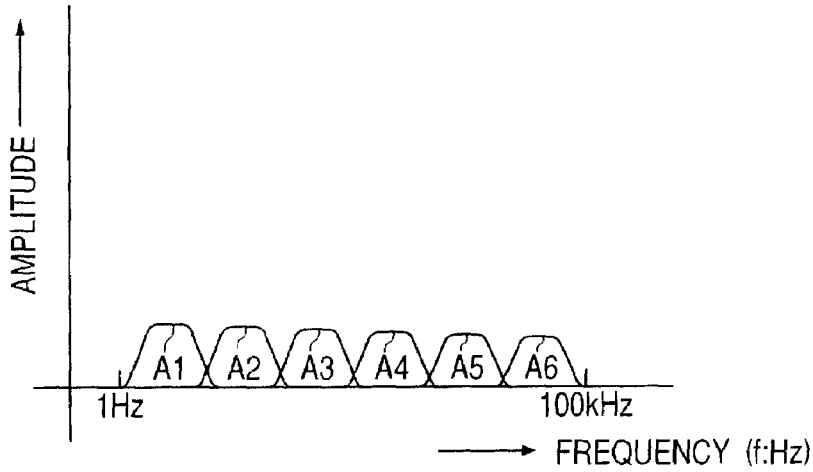
FIG. 10 is a diagram showing a frequency to amplitude characteristic of a compound optical microphone device used in the present invention II.
Figure 11:
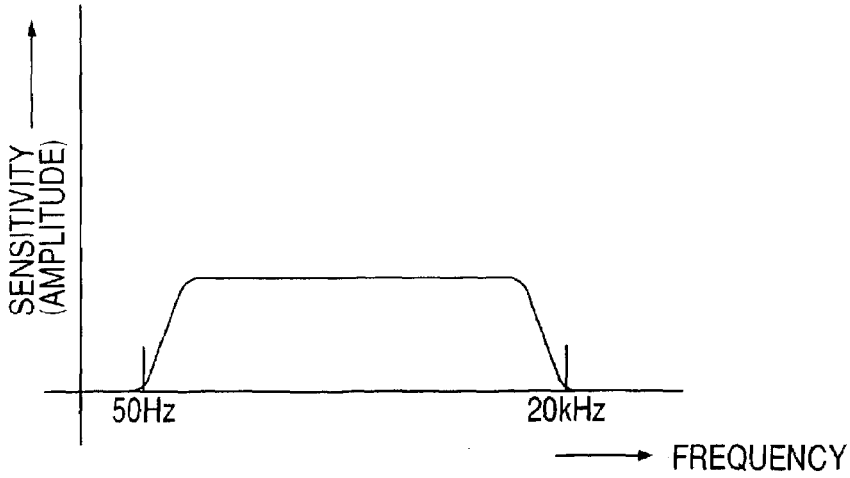
FIG. 11 is a diagram showing the frequency to amplitude characteristic of a monotone type microphone in the past.

FIG. 10 shows an amplitude characteristic in the case where the thicknesses of the vibrating board of each optical microphone devices M1 to M6 are changed and the frequencies reproducible for each of them are dividedly assigned.

For instance, assignment is performed to the optical microphone device M1 to be able to reproduce the sound waves in the lowest frequency range, and to the optical microphone device M6 to be able to reproduce the sound waves in the highest frequency range. In this case, it is necessary to render the vibrating board thickest for the optical microphone device M1 and to render it thinnest for the optical microphone device M6.

Thus, it is possible to obtain the amplitude characteristic as shown in FIG. 10 by selecting the thickness of the vibrating board so that, according to the frequency range assigned to each optical microphone device, the amplitude characteristic thereof becomes almost flat.

Moreover, the amplitude characteristics of the optical microphone devices M1 to M6 are corresponding to A1 to A6 shown in FIG. 10 respectively.

It is possible to obtain the compound optical microphone device having the flat amplitude characteristic in the entire frequency range as shown in FIG. 10 by inputting the amplitude characteristics of the plurality of optical microphone devices to the mixer circuit 71 shown in FIG. 7 and synthesizing them.

Thus, according to the present invention, it is possible to implement the optical microphone apparatus of which frequency characteristic of the sensitivity from the mixer circuit 71 is almost flat in the range of 1 Hz to 100 KHz. In addition, it is possible to implement miniaturization by configuring the optical microphone device with the vertical cavity surface emitting laser (VCSEL) diode and the photodiode (PD) configured in a monolithic structure. For this reason, the miniaturization is possible even when the plurality of optical microphone devices are combined.

Invention III

Figure 12:
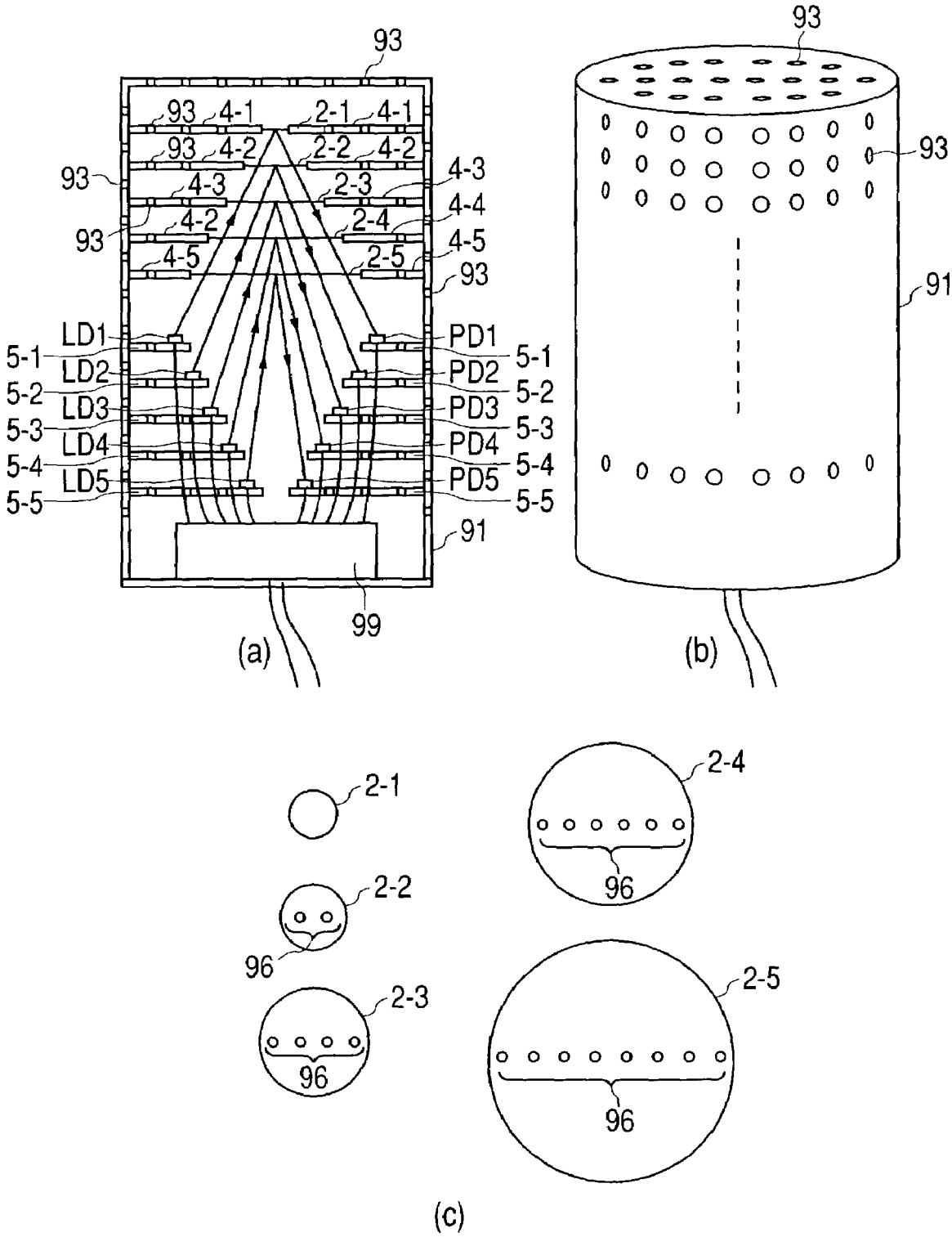
FIG. 12 is a diagram showing the configuration of an acoustoelectric transducer related to a first embodiment of the present invention III.

FIG. 12 is a diagram showing a first embodiment of the acoustoelectric transducer of the present invention III, where (a) shows a sectional view and (b) shows an external view thereof.

In the embodiment shown in FIG. 12, vibrating boards 2-1 to 2-5 are arranged on different planes in parallel with predetermined spacing, and light-emitting devices LD1 to LD5 and light-receiving elements PD1 to PD5 are provided in correspondence with the respective vibrating boards 2-1 to 2-5. The vibrating boards 2-1 to 2-5 have a disc configuration of the same thickness and different sizes. The respective vibrating boards 2-1 to 2-5 are mounted on vibrating board mounting members 4-1 to 4-5 formed in a cabinet 91 respectively. In addition, the light-emitting devices LD1 to LD5 and the light-receiving elements PD1 to PD5 are mounted on light-emitting and light-receiving device mounting members 5-1 to 5-5 respectively. Supply of a driving current to the light-emitting devices LD1 to LD5 and fetching of a light-receptive current from the light-receiving elements PD1 to PD5 are performed via an electronic circuit board 99. Moreover, in order to ensure coming of the sound waves to the vibrating boards 2-1 to 2-5 and provide directivity to the front and rear thereof, a large number of openings 93 are provided to the cabinet 91 and the mounting members 4-1 to 4-5 and 5-1 to 5-5. When focusing the light irradiated from the light-emitting devices LD1 to LD4 on the centers of the respective vibrating boards 2-1 to 2-4, the vibrating boards 2-2 to 2-5 existing closer become obstacles. Accordingly, small holes 6 are provided on the closer vibrating boards in order to pass the incident light and the reflected light as shown in FIG. 12(*c*). Here, a basic resonance frequency $F_0$ of the vibrating boards 2-1 to 2-5 shown in FIG. 12 is indicated by the following formula.

$$F_0=(0.467t/R^2)\sqrt{\{Q/\rho(1-\sigma^2)\}}$$

Here, t=thickness of the vibrating board (cm)

R=radius of the vibrating board to a peripherally clamped position (cm)

ρ=Density (g/cm$^3$)

σ=Poisson's ratio

Q=Young's modulus (dyne/cm$^2$)

Figure 17:
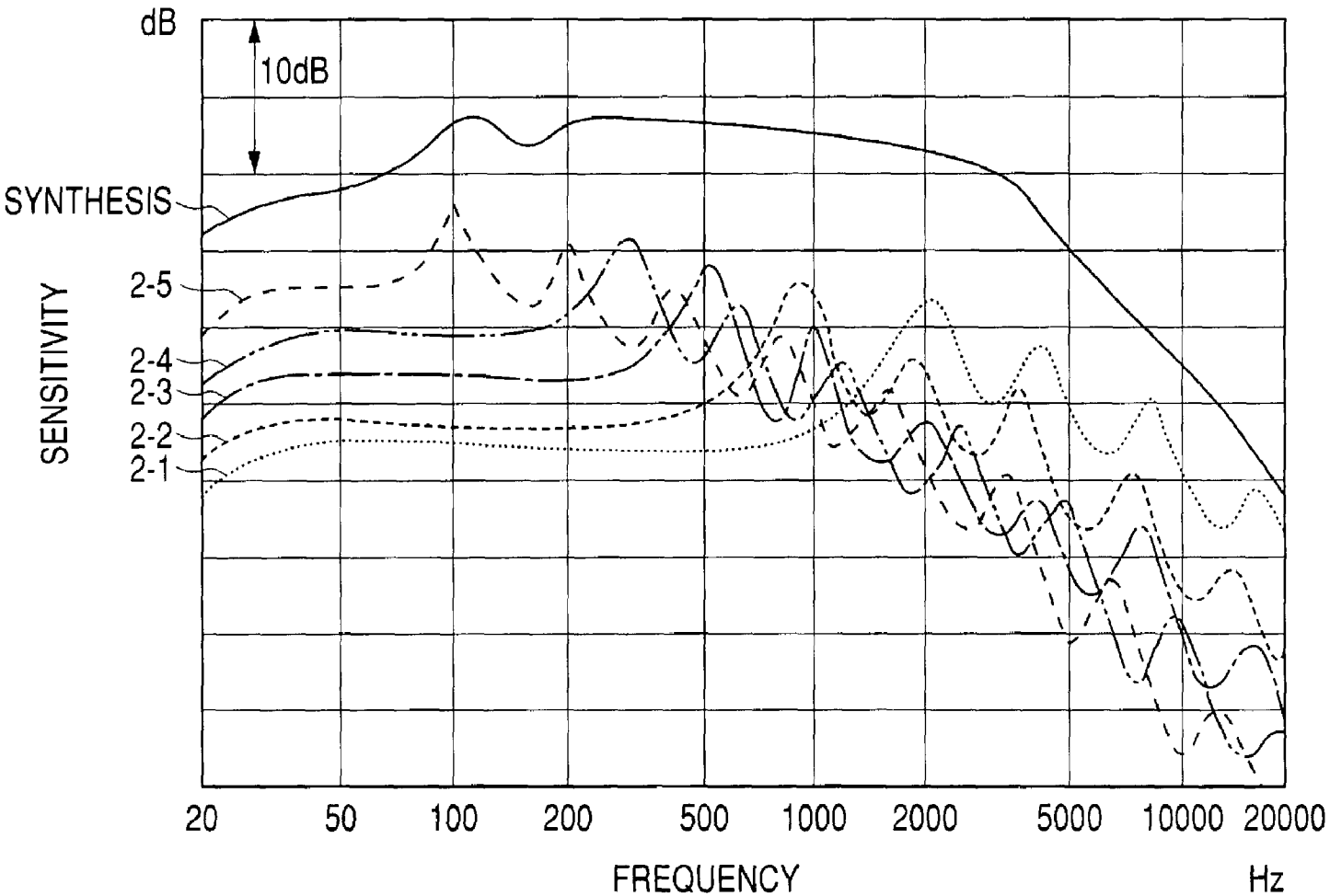
FIG. 17 is a diagram showing frequency and sensitivity characteristics of the acoustoelectric transducer of the present invention III.

To be more specific, as the basic resonance frequency $F_0$ is inversely proportional to a square of the radius of the vibrating board, a quadruple frequency can be obtained if the radius becomes half. Furthermore, in the case of the basic resonance frequency or a resonance frequency of even number times thereof, it becomes a division mode wherein the amplitude is the largest around the center thereof, and so the sensitivity becomes extremely high around the resonance frequency when the light is focused thereon. Accordingly, in this embodiment, the radiuses of the vibrating boards 2-1 to 2-5 are set to be $1:\sqrt{3}:\sqrt{5}:\sqrt{9}:\sqrt{20}$, where the respective resonance frequencies are superimposed so as to cover a wide frequency band. Here, as the voice band is emphasized, the basic resonance frequency of the vibrating board 2-5 that is the highest is set at 100 Hz. Thus, the extremely high sensitivity is obtained in the range of approximately 100 to 3,000 Hz as shown in FIG. 17.

In addition, if the space among the respective vibrating boards is large, deterioration of the directivity becomes worse even at low frequencies due to deviation of phases, and so it is desirable to place the vibrating boards with the spacing as narrow as possible. Here, it is set at approximately 2 mm so as to obtain stable sensitivity up to the frequency characteristic of 20 kHz or so.

Figure 13:
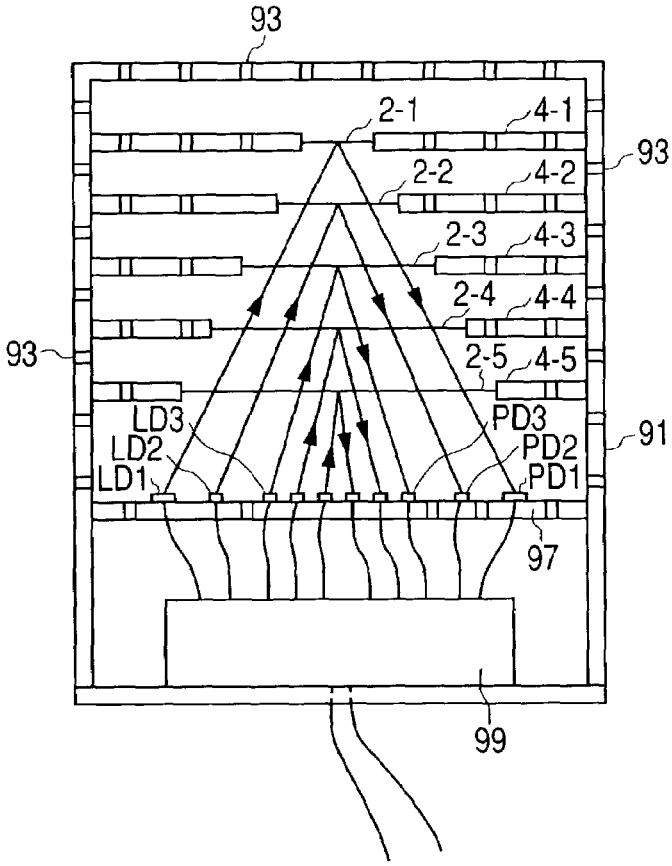
FIG. 13 is a diagram showing a second embodiment of the present invention III.

FIG. 13 shows a sectional structure of the acoustoelectric transducer related to a second embodiment of the present invention III. This embodiment is different from the first embodiment in that the light-emitting devices LD and the light-receiving elements PD are placed on the same mounting member 97. Adoption of such a configuration allows the shape of the apparatus to be miniaturized compared to the first embodiment.

Figure 14:
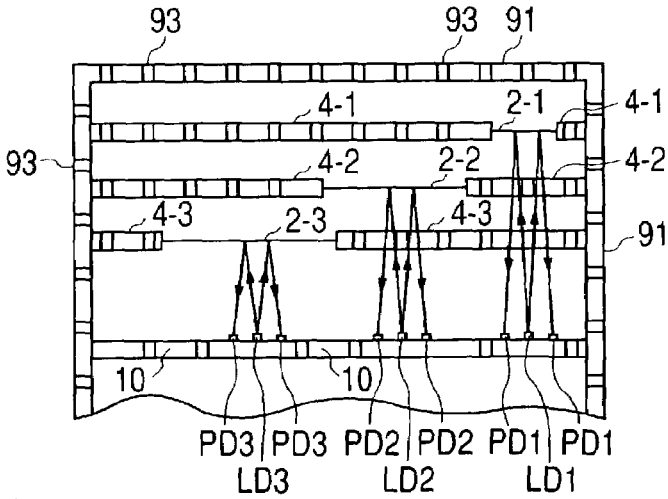
FIG. 14 is a diagram showing a third embodiment of the present invention III.

FIG. 14 shows the sectional structure of the acoustoelectric transducer related to a third embodiment of the present invention III.

In the present invention III, the light-emitting devices and the light-receiving elements are placed on the same mounting member 97 as in the embodiment shown in FIG. 13. While it is necessary, in the case of the embodiments shown in FIG. 12 and FIG. 13, to provide the small holes 96 on the closer vibrating boards just to pass the incident light and the reflected light, it is configured, by arranging the vibrating boards 2 to deviate sideward respectively, to prevent change of the shape of the vibrating boards (2-1 to 2-5) and change of the frequency characteristics due to provision of such holes 96 and to make small holes on mounting members 4-2 and 4-3 to pass the light. This makes it unnecessary to make small holes on the vibrating boards. In addition, in the case of the acoustoelectric transducer as shown in FIG. 14, it is possible to use the vertical cavity surface emitting laser diodes (VCSEL) for the light-emitting device and use the light-emitting and light-receiving device wherein an arrangement is made to concentrically surround the device as shown in FIG. 4.

Figure 15:
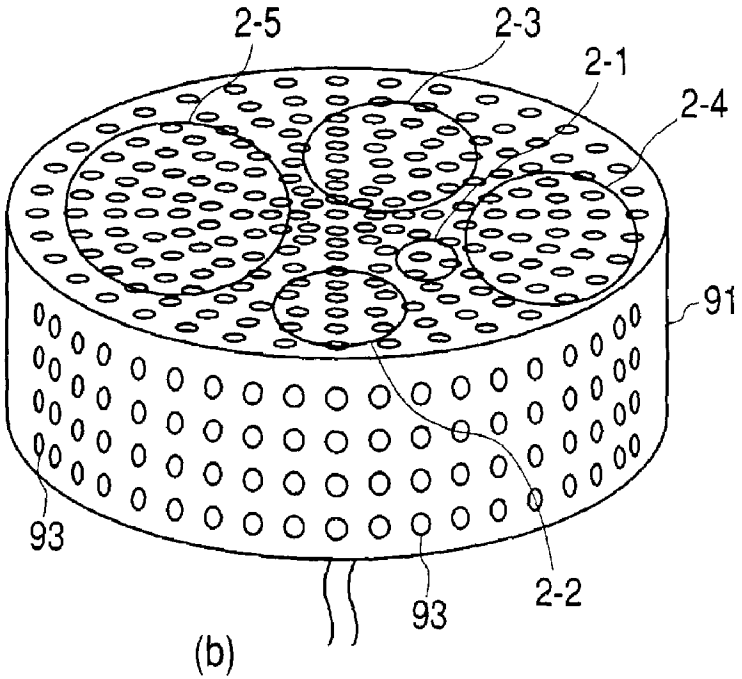
FIG. 15 is diagrams showing a fourth embodiment of the present invention III.
Figure 15:
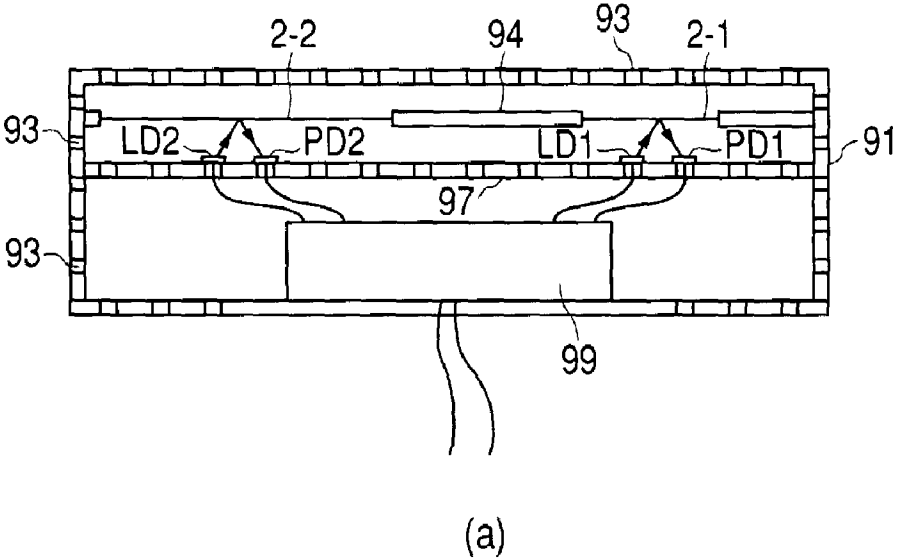

FIG. 15 show a block diagram of the acoustoelectric transducer related to a fourth embodiment of the present invention III, where (a) shows a sectional view and (b) shows an external view thereof. This embodiment has all the vibrating boards (2-1 to 2-5) placed on a mounting members 94 which are on the same plane. In addition, the light-emitting devices and light-receiving elements are placed likewise on the same mounting member 97 in correspondence with each vibrating board. It is possible, by adopting such a configuration, to render the vertical thickness smaller while the horizontal thickness increases. It is also feasible, in this embodiment, to use the light-emitting and light-receiving device as shown in FIG. 4.

Figure 16:
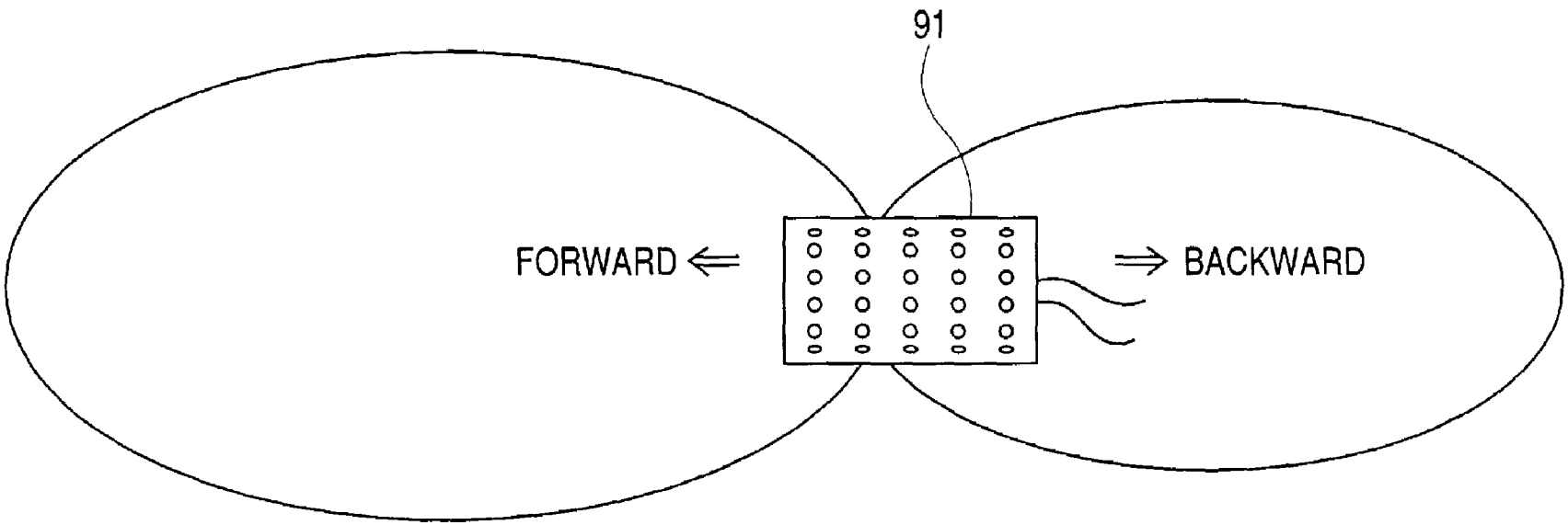
FIG. 16 is a diagram showing directivity of the acoustoelectric transducer of the present invention III.

As a result of using the configuration described above, the directivity that can be finally obtained by synthesizing sensitivity characteristics from such a plurality of vibrating boards takes the form as shown in FIG. 16. While a gain is slightly impaired by the existence of other vibrating boards, the light-emitting devices and light-receiving elements and other components in the rear, it is possible to implement the acousto-electric transducer having sharp directivity forward and backward.

Moreover, in the case where the vibrating board is horizontally placed as shown in FIG. 15, high frequency characteristics deteriorate compared to the one vertically placed, the forward and backward directional characteristics take almost the same form as the vertical one shown in FIG. 16.

As described above, it is possible, by combining the plurality of optical microphone apparatuses, to configure a directional microphone apparatus of the wide frequency band.

However, in such a configuration of the apparatus, the light-emitting devices and the vibrating boards are used at a ratio of 1:1 when combining the plurality of devices, and so a plurality of pairs of combinations of vibrating boards and light-emitting devices are required.

Thus, the apparatus of which relationship between the vibrating boards and the light-emitting devices is 1:1 has a problem that the vibrating boards cannot be closely placed or their shape becomes larger. Therefore, the present invention has the configuration, as a further improvement, wherein the plurality of vibrating boards are associated with one light-emitting device in order to implement the directional optical microphone apparatus of a small size and having wide-band frequency characteristics and reduce costs by decreasing the number of relatively expensive light-emitting devices used thereon. It is thereby possible to cut the number of the light-emitting devices so as to implement the optical acoustoelectric transducer of the small size and having the directivity of which frequency bandwidth is wide.

Hereafter, a concrete configuration thereof will be described.

Figure 18:
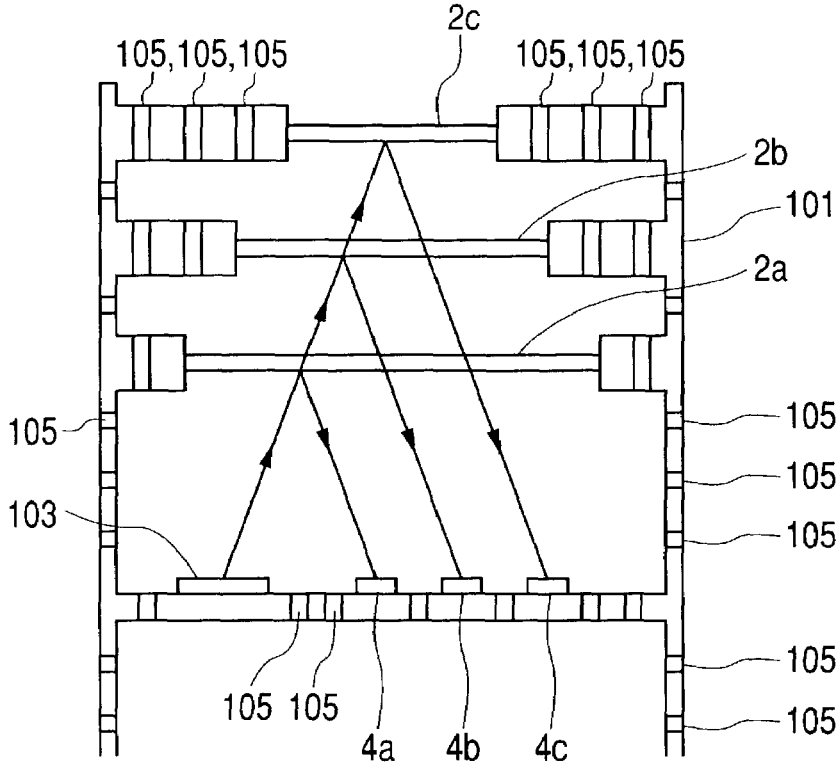
FIG. 18 is a diagram showing a fifth embodiment of the present invention III.

FIG. 18 is a sectional view of the acoustoelectric transducer showing a fifth embodiment related to the further improvement of the present invention III.

A plurality of vibrating boards 2*a*, 2*b* and 2*c* are vertically placed and mounted step-wise in a cabinet 101.

And a single light-emitting device 103 is mounted in the lower portion of these vertically placed vibrating board.

In addition, the light-receiving elements 4*a*, 4*b* and 4*c* are arranged and mounted on the same plane where the light-emitting device 103 is mounted respectively.

Moreover, openings 105 for rendering the sound waves from the outside incident are provided on an outer wall surface of the cabinet 101, the mounting members of the vibrating boards 2*a*, 2*b* and 2*c*, and mounting plates of the light-emitting device 103 and the light-receiving elements 4*a* to 4*c*.

It is configured, by providing such openings 105, to have the sound waves incident from the front and back of the respective vibrating boards 2*a* and 2*b*.

Thus, the optical microphone apparatus comes to have bi-directivity on the front and back of the vibrating boards.

In addition, it is desirable to use the VCSEL as the light-emitting device 103.

A laser beam radiated from the light-emitting device 103 gets incident on the vibrating board 2*a*, and is partially reflected and gets incident on the light-receiving element 4*a*.

In addition, a portion thereof passes through this vibrating board 2*a*, and gets incident on the vibrating board 2*b*.

The light incident on the vibrating board 2*b* is also partially reflected here and gets incident on the light-receiving element 4*b*.

In addition, the light which passed through the vibrating board 2*b* gets incident on the vibrating board 2*c*, and is reflected here and gets incident on the light-receiving element 4*c*.

Accordingly, it is necessary to use a material having a half mirror effect for the vibrating boards 2*a* and 2*b*.

The shapes of the vibrating boards 2*a*, 2*b* and 2*c* are defined to have different acoustic resonance frequencies respectively.

In the example shown in FIG. 18, the respective vibrating boards have different sizes.

Accordingly, the small-sized vibrating board 2*c* has a higher resonance frequency, and the large-sized vibrating board 2*a* has a lower resonance frequency.

Thus, the frequency characteristics obtained by using the vibrating boards having different shapes and totalizing output from the three vibrating boards are the wide-band frequency characteristics.

That is, sound receiving characteristics are formed by synthesizing peak characteristics of three vibrating boards 2*a*, 2*b* and 2*c*, to render the gain higher in a desired frequency range.

In addition, while output characteristics obtained by totalizing the output of the three light-receiving elements 4*a* to 4*c* are influenced by the other vibrating boards, the light-emitting device 103 and the light-receiving elements 4*a* to 4*c* in the rear of the vibrating boards and a little gain is lost, it is possible, as the openings 105 allow the vibrating boards to vibrate freely, to have the sharp directivity forward and backward.

Moreover, it is not always necessary to place the light-emitting device 103 and the light-receiving elements 4*a* to 4*c* on the same plane in spite of their placement in FIG. 18.

In addition, it is sufficient to define the shapes of the plurality of vibrating boards 2*a* to 2*c* to have different acoustic resonance frequencies respectively, not necessarily having to form them only to have different sizes, and it is also possible to change their thicknesses so as to form them to have different acoustic resonance frequencies respectively.

Figure 19:
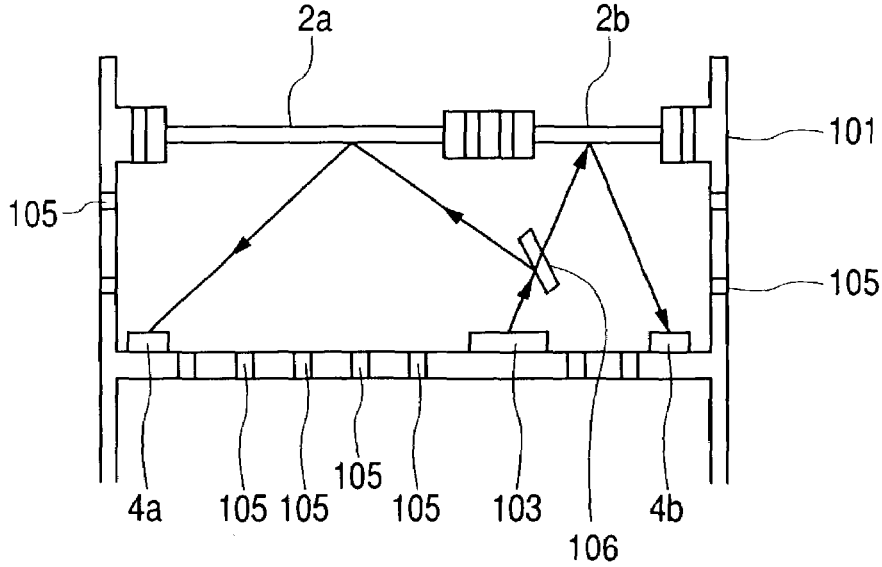
FIG. 19 is a diagram showing a sixth embodiment of the present invention III.

FIG. 19 is a sectional view of the acoustoelectric transducer showing a sixth embodiment related to the further improvement of the present invention III.

This embodiment has the vibrating boards 2*a* and 2*b* placed on the same plane.

Furthermore, the light-emitting device 103 and the light-receiving elements 4*a* and 4*b* are placed on the same plane.

In addition, a half mirror 106 is placed in a predetermined position in the cabinet 101.

The light radiated from the light-emitting device 103 is partially reflected by the half mirror 106, hits the vibrating board 2*a* and is reflected thereon to get incident on the light-receiving element 4*a*.

On the other hand, the portion of the light having passed through the half mirror 106 gets incident on the vibrating board 2*b*, and is reflected thereon to get incident on the light-receiving element 4*b*.

The light thus irradiated from the light-emitting device 103 is distributed by the half mirror 106, and is reflected by the vibrating boards 2*a* and 2*b* to get incident on the light-receiving elements 4*a* and 4*b* respectively.

According to the configuration shown in FIG. 19, it is possible to implement a further miniaturized acoustoelectric transducer since vertical length can be rendered shorter than the configuration shown in FIG. 18.

Moreover, it is also possible, in the configuration shown in FIG. 19, to render the shapes of the vibrating boards 2*a* and 2*b* different so as to render the respective acoustic resonance frequencies different.

The acoustic characteristics thus synthesized can render the gain even in the wide frequency band.

In addition, it is possible, by using the VCSEL as the light-emitting device 103, to render the diameter of the light-emitting beam extremely thin and set focal distance freely enough to provide a degree of freedom to the distance between the vibrating boards and the light-emitting device.

Thus, according to the above improved apparatus of the present invention III, it is possible to closely place the vibrating boards to one another and besides, to have the configuration having no obstacle between them so as to implement the microphone apparatus having the extremely sharp directivity and the frequency characteristics extended to high frequencies by totalizing the bi-directivity of the respective vibrating boards.

While the configurations of the present invention I to III were described in detail above by taking the optical microphone apparatus as an example, it is needless to say that the present invention is not limited to the optical microphone apparatus but is applicable to an acoustic sensor and so on.

INDUSTRIAL APPLICABILITY

As described in detail above based on the embodiments, it is possible, according to the present invention I, to provide the openings on the bottom plate having the light-emitting and light-receiving device placed thereon provided opposite the vibrating boards so as to primarily render the noise incident on the vibrating boards and thereby reduce the noise. And it is also possible to render a directional pattern close to an ideal shape like a letter 8.

In addition, according to the present invention II, it is possible to implement the acoustoelectric transducer of which amplitude characteristic is almost even over the wide frequency band because an acoustoelectric transducing device compounded by combining a plurality of acoustoelectric transducing devices is configured and the thicknesses of the respective vibrating boards of the plurality of acoustoelectric transducing devices are combined to render the receiving sensitivity almost even in different frequency ranges.

Accordingly, it is possible to widely utilize the acoustoelectric transducer of the present invention as the microphone apparatus for music suitable for the future digital age. In addition, it can be used not only as the microphone apparatus but also as the acoustic sensor.

Furthermore, according to the present invention III, it is possible to implement the acoustoelectric transducer of good directivity which is small-sized and has wide-band characteristics by adopting the configuration wherein the plurality of vibrating boards are placed on the same plane or on different planes and the light-emitting and light-receiving device is provided in correspondence therewith. In addition, it is possible to implement the apparatus capable of changing the sizes of the respective vibrating boards to change the frequency characteristics and gathering sound efficiently in the wide frequency band.

In addition, it is possible, by using the VCSEL as the light-emitting device, to render the diameter of the light-emitting beam extremely thin and thereby set focal distance relatively freely.

Accordingly, it is possible to provide the degree of freedom to the distance between the vibrating boards and the light-emitting device.

Thus, it is possible to place the plurality of vibrating boards very closely to one another and besides, to have no obstacle among them so as to implement the acoustoelectric transducer having the extremely sharp directivity and the characteristics extended to the wide frequencies by totalizing the bi-directivity of the individual vibrating boards.

Furthermore, it is possible, in the case of using the vibrating boards of different diameters, to arbitrarily change the frequency characteristics by differences in the resonance frequencies determined by the diameters of the vibrating boards. Accordingly, it is possible to implement the directional acoustoelectric transducer of extremely high sensitivity by using the most efficient band. Moreover, it is possible to implement the directional acoustoelectric transducer having an advantage in terms of costs by further improving it to place the plurality of vibrating boards to one light-emitting device.

The invention claimed is:

1. An optical acoustoelectric transducer, said transducer comprising:

a vibrating board vibrating due to sound pressure;

a light-emitting device for irradiating a light beam on said vibrating board;

a plurality of light-receiving elements for receiving the reflected light of said light beam irradiated on said vibrating board and outputting a signal corresponding to the vibration displacement of said vibrating board;

a bottom plate comprising said light-emitting device and said light-receiving elements placed thereon and provided opposite to said vibrating board; and a supporting side plate for coupling said vibrating board and said bottom plate to be mounted almost in parallel and closely, wherein said light-emitting device and light-receiving elements are placed almost in the center of said bottom plate, with a first opening of a size allowing a sound wave to enter provided in a periphery, wherein a second opening of a size allowing a sound wave to enter is provided on said supporting side plate, wherein said optical acoustoelectric transducer has a light emitting/receiving device wherein said light-emitting device and said light-receiving elements are placed on the same substrate, said light-emitting device being a vertical cavity surface-emitting light-emitting device whose intensity distribution of light emission is concentrically almost even and being placed in the center of said substrate, said light-receiving elements being placed concentrically to surround said light-emitting device.

2. The optical acoustoelectric transducer according to claim 1, further comprising a plurality of first openings allowing a sound wave to enter provided in a periphery.

3. The optical acoustoelectric transducer according to claims 1 or 2, wherein a plurality of said second openings are provided.

4. The optical acoustoelectric transducer according to claim 2, wherein said vibrating board is placed almost in parallel with and close to said substrate.

5. The optical acoustoelectric transducer according to any one of claims 1 to 2, wherein said optical acoustoelectric transducing device is placed so as to expose said vibrating board in the opening formed on a frame surface of said supporting frame.

6. An optical acoustoelectric transducer, said transducer comprising:

a plurality of optical acoustoelectric transducing devices, each optical acoustoelectric transducing device comprising a vibrating board for vibrating due to sound pressure, a light-emitting device for irradiating a light beam on said vibrating board, and a light-receiving element for receiving the reflected light of said light beam irradiated on said vibrating board and outputting a signal corresponding to the vibration displacement of said vibrating board;

a supporting frame for placing and fixing said plurality of said optical acoustoelectric transducing devices to position their vibrating boards almost on the same plane;

a light source driving circuit for driving said light-emitting devices by supplying a predetermined current to each of the light-emitting devices of said plurality of optical acoustoelectric devices; and a mixer circuit for mixing the output signal from each respective light-receiving element of said plurality of optical acoustoelectric transducing devices, wherein the thicknesses of respective vibrating boards of said plurality of optical acoustoelectric transducing devices are rendered different so as to make receiving sensitivity almost even in mutually different frequency ranges.

7. The optical acoustoelectric transducer according to claim 6, wherein said optical acoustoelectric transducer comprising said plurality of optical acoustoelectric transducing devices has a light emitting/receiving device, wherein said light-emitting devices and said light-receiving elements are placed on the same substrate, said light-emitting devices being a vertical cavity surface-emitting light-emitting device whose intensity distribution of light emission is concentrically almost even and being placed in the center of said substrate.

8. The optical acoustoelectric transducer according to any one of claims 1 to 2, wherein in that a frequency characteristic of sensitivity of the output signals from said mixer circuit is almost flat in the frequency range of 1 Hz to 100 KHz.

9. An optical acoustoelectric transducer comprising, in a cabinet of the optical acoustoelectric transducer, a plurality of vibrating boards vibrating due to sound pressure, a light-emitting device for rendering light incident on said plurality of vibrating boards and a plurality of light-receiving elements for receiving the reflected lights from said plurality of vibrating boards and converting the acoustic displacements of said plurality of vibrating boards to electric signals to output the converted electric signals, wherein each of said plurality of said vibrating boards corresponds to one of said plurality of receiving elements, wherein said plurality of said vibrating boards are placed in parallel on respective different planes arranged maintaining a predetermined spacing.

10. The optical acoustoelectric transducer according to claim 9, wherein a plurality of light-emitting devices are provided to correspond to each of said plurality of light-receiving elements and each of said plurality of vibrating boards, respectively.

11. The optical acoustoelectric transducer according to claim 10, wherein each of said plurality of light-emitting devices is placed on the same plane as the light-receiving element corresponding thereto.

12. The optical acoustoelectric transducer according to claim 9, wherein said plurality of vibrating boards are comprised of a combination of the vibrating boards having respective different fundamental frequencies.

13. The optical acoustoelectric transducer according to claim 12, wherein said plurality of vibrating boards are comprised of a combination of the vibrating boards having the same thickness and respective different sizes.

14. The optical acoustoelectric transducer according to claim 9, wherein a number of openings are provided to said cabinet so that sound reaches said vibrating boards via said openings.

15. An optical acoustoelectric transducer comprising, in a cabinet of the optical acoustoelectric transducer, a plurality of vibrating boards vibrating due to sound pressure, a light-emitting device for rendering light incident on said plurality of vibrating boards, and a plurality of light-receiving elements for receiving the reflected lights from said vibrating boards and converting the acoustic displacements of said plurality of vibrating boards to electric signals to output the converted electric signals, wherein said plurality of vibrating boards are placed on the same plane apart from one another, said optical acoustoelectric transducer further comprising:

a mixer circuit for mixing the output signals from each of said plurality of light-receiving elements;

wherein the thicknesses of respective vibrating boards are rendered different so as to make receiving sensitivity almost even in mutually different frequency ranges.

16. An optical acoustoelectric transducer comprising, in a cabinet of the optical acoustoelectric transducer, a plurality of vibrating boards vibrating due to sound pressure, a light-emitting device for rendering light incident on said plurality of vibrating boards, and a plurality of light-receiving elements for receiving the reflected light from said plurality of vibrating boards and converting the acoustic displacements of said plurality of vibrating boards to electric signals to output the converted electric signals, wherein each of said plurality of said vibrating boards corresponds to one of said plurality of receiving elements, wherein said plurality of light-receiving elements receive light beams from a single light-emitting device via reflection paths corresponding to each of said plurality of vibrating boards, wherein the light beams are distributed via a half mirror device placed in said cabinet so that the distributed light beams are irradiated on each of said plurality of vibrating boards.

17. The optical acoustoelectric transducer according to claim 16, wherein the single light-emitting device and said plurality of light-receiving elements are placed on the same plane.

* * * * *